United States Patent [19]

Yang

[11] Patent Number: 4,766,917

[45] Date of Patent: Aug. 30, 1988

[54] EASILY-FOLDED LINK MEANS OF MULTIPLE-FOLD UMBRELLA

[76] Inventor: Chi-Kuo Yang, P.O. Box 10160, Taipei, Taiwan

[21] Appl. No.: 79,710

[22] Filed: Jul. 30, 1987

Related U.S. Application Data

[63] Continuation-in-part of Ser. No. 882,423, Jul. 7, 1986, Pat. No. 4,676,262.

[51] Int. Cl.[4] ..... A45B 19/00

[52] U.S. Cl. ..... 135/25 R

[58] Field of Search ..... 135/20, 25, 26

[56] References Cited

U.S. PATENT DOCUMENTS 3,848,740 11/1974 Weber ..... 135/25 R 4,420,007 12/1983 Wu ..... 135/25 R 4,676,262 6/1987 Yang ..... 135/25 R

FOREIGN PATENT DOCUMENTS 645789 10/1984 U.S.S.R. ..... 135/25 R

*Primary Examiner*—J. Karl Bell

[57] ABSTRACT

A link means of multiple-fold umbrella includes a plurality of link means for extending an umbrella hood as mounted on the plural link means of which a first link is pivotally secured to a central handle and a second link having its inner end pivotally secured to the central handle and having its outermost end pivotally secured with a reinforcing link operatively concealed in the first link to hold the first link when extending the plural link means so that the second link and the reinforcing link can be easily retracted to fold the umbrella.

2 Claims, 2 Drawing Sheets

EASILY-FOLDED LINK MEANS OF MULTIPLE-FOLD UMBRELLA

BACKGROUND OF THE INVENTION

This application is a Continuation-in-part of original application filed on July 7, 1986 Ser. No. 882,423 now U.S. Pat. No 4,676,262 entitled "Link Means of Multiple-fold Umbrella". Even original application disclosed a plurality of link means as shown in FIG. 1 which can be stably extended to have a generally linear configuration and can also be greatly folded to form a compact collapsible umbrella, however, when folding this umbrella by lowering the lower bracket (93), the second link (2) bearing a great moment by the tension force P acted by umbrella hood H multiplied by the distance L1 between the pin (22) and the outer end (73) will be difficultly folded as bearing such a great moment P×L1.

The present inventor has found the defects of the conventional link means and invented the present easily-folded link means of multiple-fold umbrella.

SUMMARY OF THE INVENTION

The object of the present invention is to provide an easily-folded link means including a concealed reinforcing link secured to a second link of a plurality of link means and engageable in a longitudinal groove of a first link for holding the first link and the other link means when extending an umbrella hood connected with the plurality of link means, whereby upon the lowering of the second link, the link means of the umbrella hood will be easily folded since the outer end of the second link is not pivotally connected to the first link and is therefore easily released from the engaged groove of the first link, adapted for quicker folding operation and for consuming less energy required by an umbrella user.

DETAILED DESCRIPTION

Figure 1:
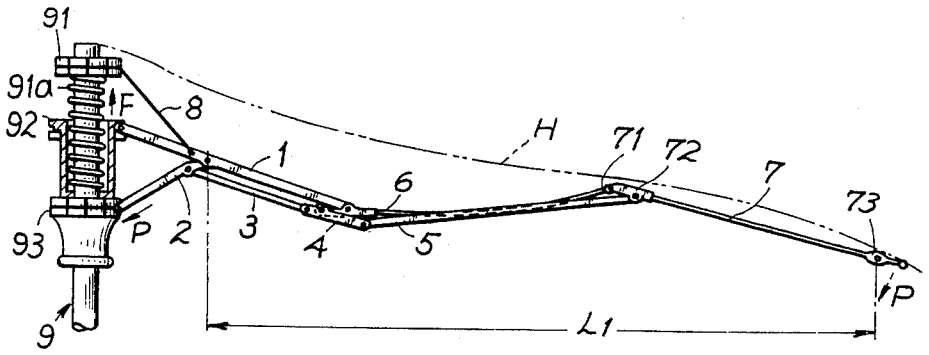
FIG 1 PRIOR ART
FIG. 1 is an illustration showing a prior art of this invention.

As shown in FIGS. 2–5, the present invention comprises: a first link 1 pivotally secured to a middle bracket 92 jacketed on a central handle 9, a second link 2 pivotally secured to a lower bracket 93 jacketed on the central handle 9, a third link 3 juxtaposedly pivotally formed under the first link 1 and having its inner end 31 pivotally secured to an outer portion 23 next to an outermost end 22 of the second link 2, a concealed reinforcing link 40 having its inner end 401 pivotally secured to the outermost end 22 of the second link 2, a fourth link 5 having its innermost end 521 secured with the outer end 32 of the third link 3 and having its inner portion 522 next to the innermost end 521 respectively secured with an outer end 402 of the concealed reinforcing link 40 and an outermost end 13 of the first link 1, a spring link 6 having its central portion 62 arcuatedly bent to be slidingly held within a collar 51 fixed on a central portion of the fourth link 5 and having its inner end 62 secured to an outer portion 14 of the first link 1, a fifth link 7 having its innermost end 71 pivotally secured to an outer end 64 of the spring link 6 and having its inner end 72 next to the innermost end 71 pivotally secured with an outer end 53 of the fourth link 5 and having its outer end 72 secured with an umbrella hood H, and a wire 8 securing the first link 1 to an upper bracket 91 fixed on a top portion of the handle 9. The inner end 11 of the first link 1 is pivotally secured to the middle bracket 92 as restored by a spring 91*a* jacketed on the handle 9 and defined between the upper bracket 91 and the middle bracket 92.

The first link 1 is formed with a longitudinal groove 10 having a U-shape cross section. The transverse width of the groove 10 should be slightly larger than the diameter of the reinforcing link 40, so that the groove 10 is adapted for snugly receiving the link 40 therein. The concealed reinforcing link 40 is generally parallel to the third link and is operatively engaged with the groove 10 for supporting the first link 1 when raising the lower bracket 93 to lift the second link 2 until the outermost end 22 touching the first link 1.

Figure 2:
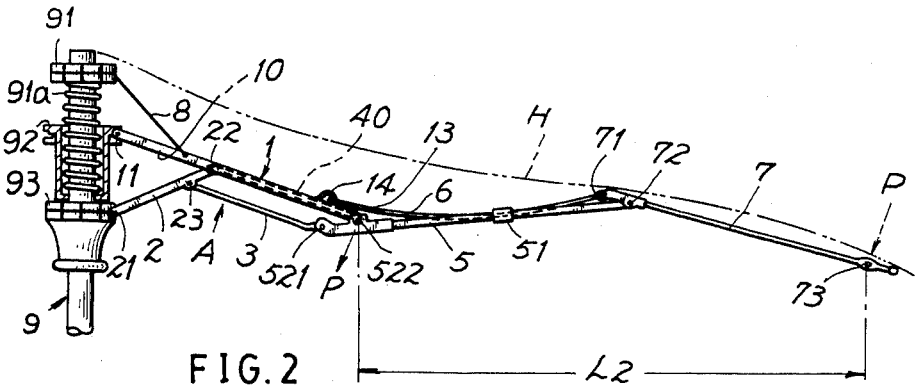
FIG. 2 is an illustration of the present invention as extended.

When extending the plural link means of the present invention as shown in FIG. 2, the lower bracket 93 is raised (direction F) to lift the second link 2 to allow the reinforcing link 40 being engaged with the groove 10 of the first link 1 to hold the first link 1 and other link means, adapted for extending the umbrella hood H for shielding purpose.

Figure 3:
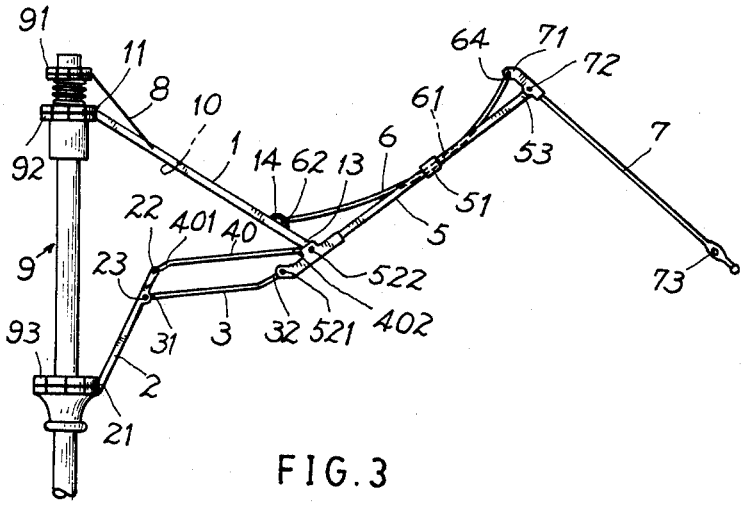
FIG. 3 is an illustration of the present invention when being folded.
Figure 4:
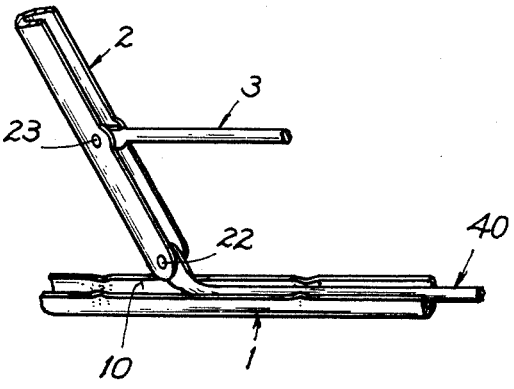
FIG. 4 is a partial perspective drawing of the link means when viewed from direction A of FIG. 2.
Figure 5:
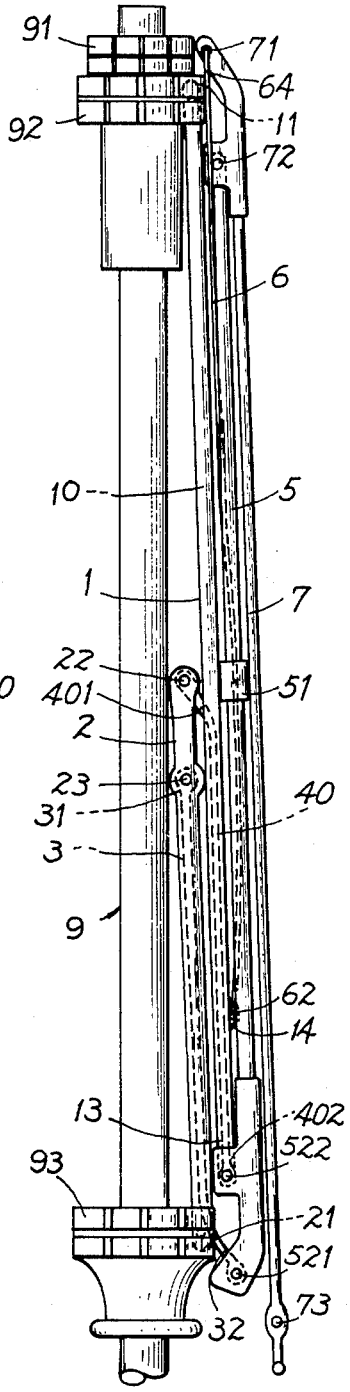
FIG. 5 is an illustration showing the present invention as folded.

When it is intended to retract the link means of the present invention, the lower bracket 93 is lowered to downwardly pull the second link 2 and the pivotally secured reinforcing link 40 to fold the link means toward the central handle 9. During downward pulling of the second link 2, the inner end 401 of reinforcing link 40 is not pivotally fixed on the first link 1 so that the link 40 will be easily lowered along with the second link 2 as being lowered to focus the forcing point P as acted by the tension of the hood H against the outer portion 522 of the fourth link 5 as shown in FIG. 2 and 3 to thereby outwardly displace the forcing point P from its original left position as shown in FIG. 1 to shorten the force arm from original L1 to be present L2. Since L2 is shorter than L1, the moment of the present invention obtained by P×L2 is less than the moment P×L1 of the conventional art as shown in FIG. 1 so that the present invention can be folded more conveniently from its extended condition.

I claim:

1. An easily-folded link means of multiple-fold umbrella comprising:

a first link pivotally secured to a middle bracket jacketed on a central handle;

a second link pivotally secured to a lower bracket jacketed on the central handle;

a third link juxtaposedly pivotally formed under said first link, having its inner end pivotally secured to an outer portion next to an outermost end of said second link;

a concealed reinforcing link secured to said second link;

a fourth link having its innermost end pivotally secured to an outer end of said third link, having its inner portion next to its innermost end pivotally secured to an outer end of said first link;

a spring link having its central portion slidingly held within said fourth link, having its inner end secured to said first link and;

a fifth link respectively pivotally secured to each outer end of either said fourth link and said spring link; and a wire securing said first link to an upper bracket fixed on a top portion of said central handle;

the improvement which comprises:

said concealed reinforcing link having its inner end pivotally secured to the outermost end of said second link and having its outer end pivotally secured to an inner portion of the fourth link next to the innermost end of the fourth link;

said concealed reinforcing link generally parallel to said third link and operatively engaged with a longitudinal groove formed in said first link, adapted for supporting said first link when raising said lower bracket and said second link for extending the plural link means and an umbrella hook for shielding purpose;

said inner portion of said fourth link respectively pivotally secured with each outer end of said reinforcing link and said first link.

2. A link means of multiple-fold umbrella according to claim 1, wherein said longitudinal groove of said first link has an U-shape cross section, the width of said groove being larger than the diameter of said concealed reinforcing link.

* * * * *